US005830107A

United States Patent [19]

Brigliadoro

[11] Patent Number: 5,830,107

[45] Date of Patent: Nov. 3, 1998

[54] EXERCISE PLATFORM WITH PERFORMANCE DISPLAY

[76] Inventor: George R. Brigliadoro, 9 Hopi Ct., Oakland, N.J. 07436

[21] Appl. No.: 842,706

[22] Filed: Apr. 17, 1997

[51] Int. Cl.[6] ..... A63B 21/015; A63B 22/14

[52] U.S. Cl. ..... 482/1; 482/3; 482/8; 482/51; 482/118; 482/147

[58] Field of Search ..... 482/3, 8, 9, 51, 482/52, 62, 147, 1, 146

[56] References Cited

U.S. PATENT DOCUMENTS

| | | | |
|---|---|---|---|
| 4,200,282 | 4/1980 | Agyagos | 482/147 |
| 5,078,389 | 1/1992 | Chen | 482/147 X |
| 5,137,501 | 8/1992 | Mertesdorf | 482/57 |
| 5,207,621 | 5/1993 | Koch et al. | 482/52 X |
| 5,282,776 | 2/1994 | Dalebout | 482/52 X |
| 5,284,461 | 2/1994 | Wilkinson et al. . | |
| 5,344,376 | 9/1994 | Bostic et al. . | |
| 5,433,690 | 7/1995 | Gilman . | |
| 5,527,253 | 6/1996 | Wilkinson et al. . | |
| 5,599,262 | 2/1997 | Shih . | |

*Primary Examiner*—John Mulcahy
*Attorney, Agent, or Firm*—Terrance L. Siemens

[57] ABSTRACT

An exercise machine providing selectively variable rhythmic audible accompaniment for torso twisting and arm thrusting motions. The machine has three rotatably mounted foot platforms and two upwardly projecting, pivotable hand levers. Two of the three foot platforms are located proximate to and equidistant from the hand levers and the remaining foot platform is located distally from the hand levers. The hand levers are adjustable as to resistance to pivoting, and alternatively may be fixed in place if arm motions are not desired. A music synthesizer controls tempo of exercises. Tempo, beat, volume, and other characteristics of the music may be controlled by the user. A microprocessor sums the number and frequency of body motions and calculates energy expended while exercising. This information is transmitted to a display visible to the user.

6 Claims, 4 Drawing Sheets

EXERCISE PLATFORM WITH PERFORMANCE DISPLAY

BACKGROUND OF THE INVENTION

1. Field of the Invention

The present invention relates to exercise devices, and more particularly of the type having a rotatable foot platform and poles grasped by hand and moved reciprocatingly. The body motions induced by the devices include twisting about the pelvis and reciprocating projection of the forearm. The present invention adds a system for controlling music accompanying use of the apparatus, as well as a computerized calculator and display for totalizing and reporting movement repetitions and calories expended in performing the exercise.

2. Description of the Prior Art

Fitness and physiological condition have become ever more popular over the years, and equipment and facilities for providing exercise have developed accordingly. Small devices and machines for enabling a single person to exercise are available in commercial exercise establishments and for sale to individual consumers. Exercise equipment enables a person to focus muscular development of individual muscles and groups of complementing muscles. Cardiovascular development has also received attention from exercise apparatus.

One of the popular forms of exercise equipment is that class providing a rotating foot platform for the feet and handles for the hands. In this type of equipment, the user stands on one or more rotatable foot platforms and grasps one handle in each hand. The handles may be joined to a common member or may be individually mounted to dedicated poles pivotally mounted to the equipment. Resistance to pivoting the handles is typically provided to increase effort required by the hands and arms. This resistance may be adjustable. Such devices are typically purely mechanical in their operation, and examples are set forth below.

This type of equipment is seen in U.S. Pat. Nos. 5,284,461, issued to William T. Wilkinson et al. on Feb. 8, 1994, 5,344,376, issued to James R. Bostic et al. on Sep. 6, 1994, and 5,527,253, issued to William T. Wilkinson et al. on Jun. 18, 1996. These features are found in the present invention. However, these prior art inventions lack a system for controlling accompanying music and a calculator and associated display for counting movement repetitions and calculating effort, and reporting calories expended while exercising and number of movement repetitions performed. The music control system, calculator, and display as described form part of the present invention.

U.S. Pat. Nos. 5,433,690, issued to Stewart B. N. Gilman on Jul. 18, 1995, and 5,599,262, issued to Ching-Fu Shih on Feb. 4, 1997, set forth exercise apparatus including a rotatable foot platform and hand bars.

However, the hand bars of Gilman and Shih are solidly fixed to one another, lacking reciprocation in opposing directions, as seen in the present invention. Gilman and Shih also lack the music control system, calculator, and display of the present invention.

Automated counting and calculation of effort, and displays for reporting totalized counts and summed effort are known in other types of equipment. However, the present inventor is unaware of any such calculating and displaying scheme similar to that of the present invention.

It is also known to perform exercises offering cardiovascular benefits, popularly known as aerobic exercises, to the accompaniment of music or audible rhythmic beats. Once again, the present inventor is unaware of devices for reproducing music and audible rhythmic beats similar to those of the present invention.

None of the above inventions and patents, taken either singly or in combination, is seen to describe the instant invention as claimed.

SUMMARY OF THE INVENTION

The present invention includes three rotatable foot platforms and a pair of levers or poles each of which is grasped by one hand by the user. The novel exercise machine improves upon otherwise similar prior art exercise devices in that the three foot platforms enable both dance routines as well as twisting exercises, and also in that the invention incorporates a music synthesizer for directing use and a microprocessor and display for sensing and reporting aspects of exercise and controlling the music synthesizer. The music synthesizer produces audible accompaniment such as music or a beat or rhythm attuned to the pace of bodily motions. The pace or rhythm is adjustable to the user's preference.

The levers enable a person performing exercises to pull and push with his or her arms against an adjustably variable resistance while exercising. Alternatively, the levers may be fixed in a generally vertical position. The three foot platforms enable the body position of the user to be oriented squarely with respect to the hand levers, or to be oriented in an oblique stance wherein one leg is closer to the hand levers than is the other leg.

Exercises range from uncomplicated repetitive twisting of the torso to more complicated motions simulating dance routines. The arms of the user react to twisting of the torso move in a resistive effort wherein the hand is thrust out forwardly and subsequently drawn back towards the body, or alternatively the hands maintain constant position even as the arms move to accommodate motion of the torso.

The foot platforms have sensors which send signals to an onboard microprocessor. The signals indicate the extent or magnitude of twisting bodily motion. This data may be related to other data, such as body weight, frequency of motions, and others, and may lead to calculation of energy expended while exercising. Cumulative count of motion repetitions and energy expenditure in the form of calories consumed, as well as information relating to operating the novel exercise device are shown on the display.

The role of audible accompaniment provides great psychic encouragement and stimulation while exercising. This function replicates separate audible and videotapes which are commercially available for automated supervision of exercising. Many exercises and dance routines become onerous in the absence of stimulation and encouragement by audible accompaniment. The invention improves upon the stimulation provided by videotapes, televised audible and visual accompaniment, and similar remote supervision of exercises and dance routines by enabling the user to adjust the tempo or pace of the stimulus, the sound volume, and other characteristics according to individual preferences. At the same time, the user is advised of sensed and calculated quantified parameters of a session's efforts. This type of quantified feedback is frequently greatly encouraging, since it provides a reference or benchmark against which the user may measure progress and attainment of milestones relative to physical conditioning. The invention thus provides necessary apparatus, sensory stimulation, and quantified feedback which together enable the novel exercise device to satisfy most psychological requirements leading to psychologically and physiologically successful exercise on a machine.

Accordingly, it is a principal object of the invention to provide an exercise machine of the type enabling twisting of the torso and simultaneous reactive effort by the arms.

It is another object of the invention to provide audible stimulus or accompaniment for exercises, which stimulus is attuned and adjustable to a desired pace of bodily motions.

It is a further object of the invention to calculate repetitions and magnitude of bodily motions and to calculate energy expenditure while exercising.

Still another object of the invention is to provide a visual display for displaying sensed repetitions and calculated energy expenditures.

An additional object of the invention is to enable body stances in which the body is selectively squarely and obliquely to the hand levers.

It is again an object of the invention to selectively enable pivoting of the hand levers against variable resistance to movement of the hand levers and to immobilize the hand levers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
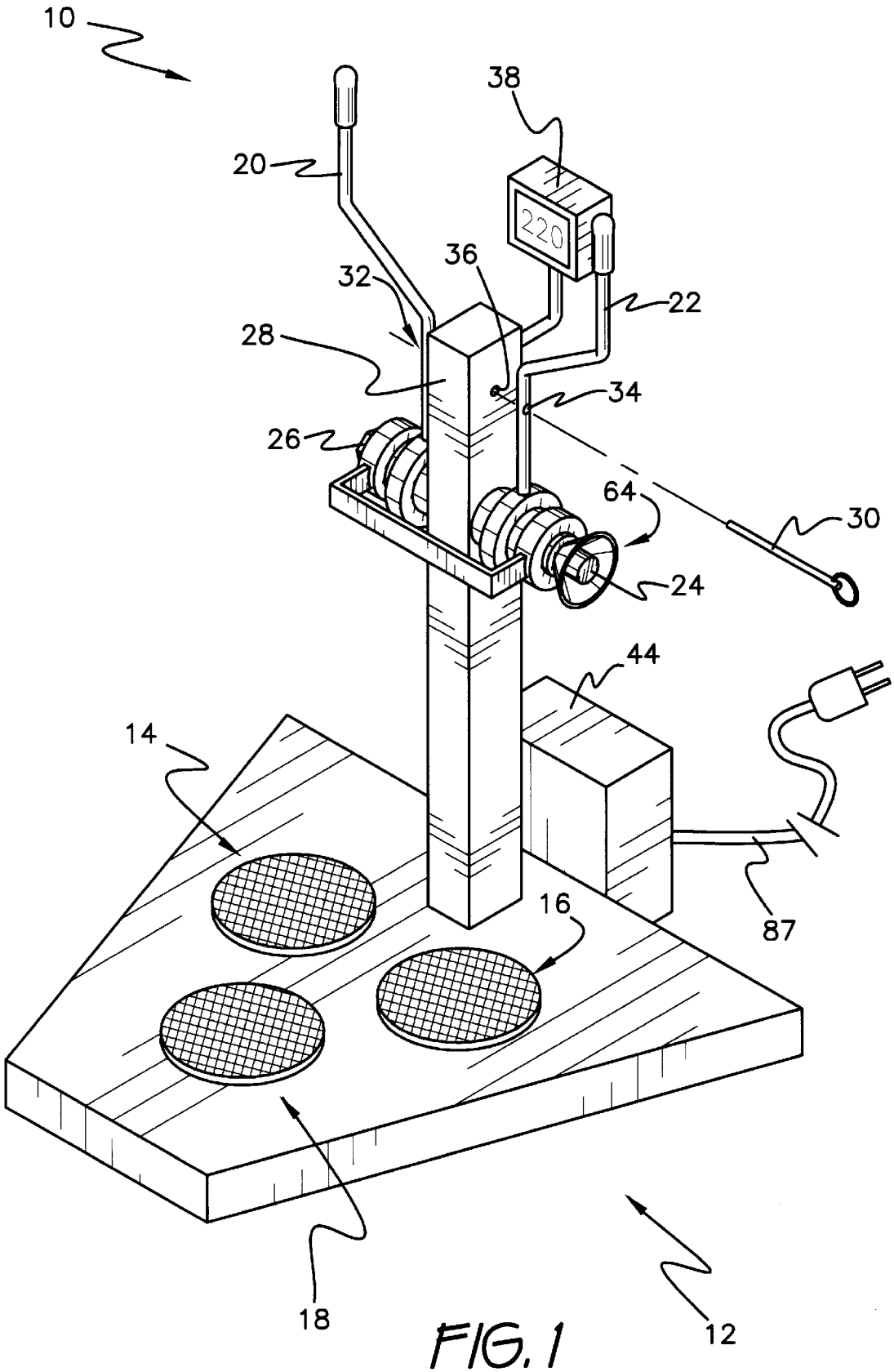
FIG. 1 is a front perspective view of the apparatus of the invention.

Turning now to FIG. 1 of the drawings, novel exercise machine 10 is seen to comprise a base 12 for supporting the other components on a horizontal surface (not shown). The components of exercise machine 10 engaging the body of a user while exercising include three rotatable foot platforms 14, 16, 18 and two hand levers 20, 22. Hand levers 20, 22 generally project upwardly from their mounting at an axle arrangement comprising a threaded bolt 24, the head 26 of which is seen at the left. The axle arrangement is supported on a mast 28 fixed to base 12.

Hand levers 20, 22 can pivot relative to bolt 24 and therefore relative to base 12. In use, they are grasped by the user, one in each hand. The user places one foot on one foot platform 14, 16, or 18, one foot platform 14, 16, or 18 being unoccupied. Foot platforms 14 and 16 are located proximate and equidistantly from hand levers 20, 22. Foot platform 18 is located distally and preferably equidistantly from hand levers 20, 22. With each foot placed off center on its selected foot platform 14, 16, or 18, the user grasps hand levers 20, 22 and performs exercises causing the torso to twist about a vertical axis. The user has previously determined whether to enable hand levers 20, 22 to pivot about bolt 24 or whether to immobilize hand levers 20, 22 relative to base 12. A mechanism for immobilizing hand levers 20, 22 is provided in the form of a pin 30 which is inserted through openings 32, 34, and 36 formed respectively in hand levers 20 and 22 and mast 28. Obviously, many stances are possible given the choice of foot positions and selection of immobilization or pivoting of hand levers 20, 22.

Figure 4:
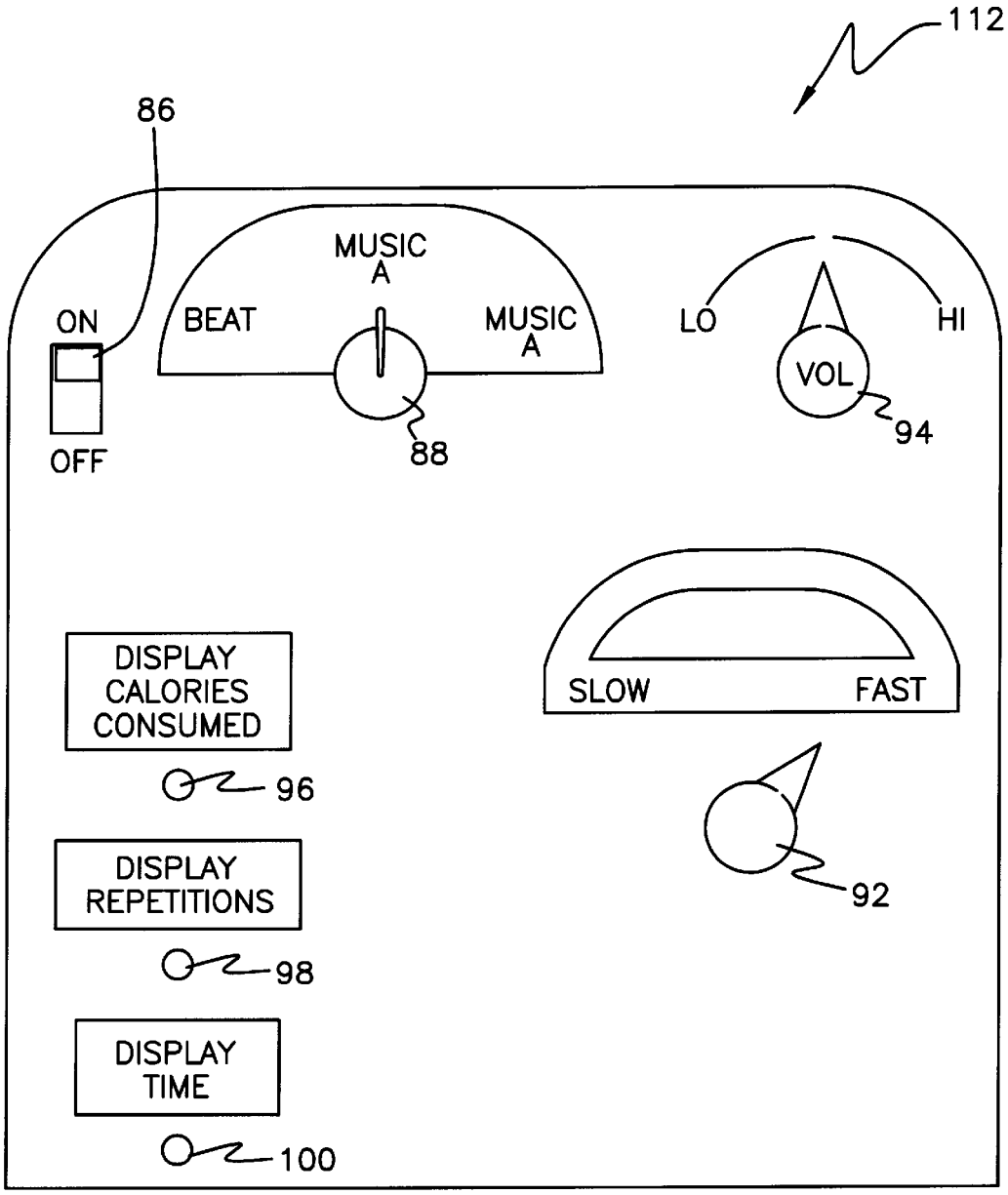
FIG. 4 is a rear elevational detail view of a component seen towards the center of FIG. 1.

Exercise machine 10 has a display, such as liquid crystal display 38 fixed to mast 28 such that the user may monitor his or her performance. A microprocessor 42 (see FIG. 5) and controls (see FIG. 4) for controlling automated functions of exercise machine 10 are contained in or on an enclosure 44 preferably fixed to base 12.

Figure 2:
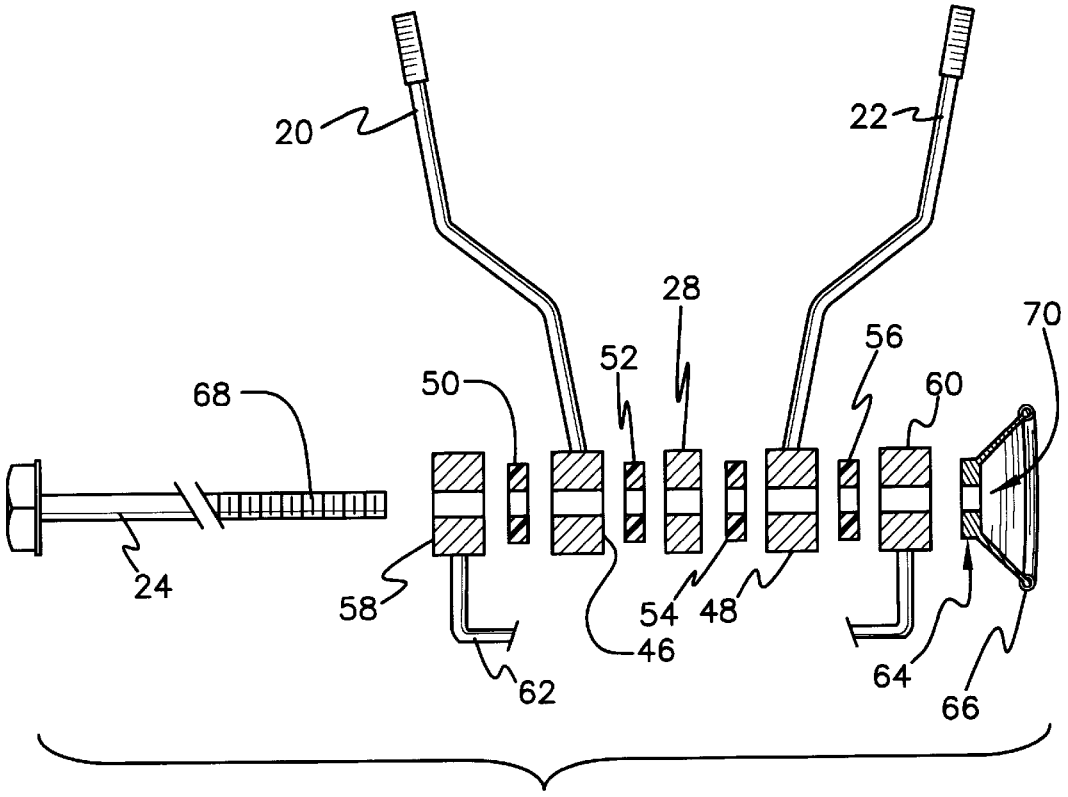
FIG. 2 is an exploded, exaggerated detail view of components seen at the center of FIG. 1.

Details of an adjustment mechanism of the axle arrangement providing pivotal mounting of hand levers 20, 22 are shown in FIG. 2. Each hand lever 20 or 22 has an associated mounting disc 46 or 48. Each mounting disc 46 or 48 is surrounded at two sides by low friction washers 50 and 52 or 54 and 56. Washers 50, 52, 54, 56 are faced with a low friction material such as polytetrafluoroethylene. A compression fitting having discs 58, 60 connected by a spanning member 62 surround mast 28, washers 50, 52, 54, 56, and mounting discs 46, 48. The compression fitting and each one of the components surrounded by the compression fitting has a smooth bore (shown but not identified by reference numeral) enabling passage of bolt 24 therethrough and smooth lateral faces for abutting adjacent components.

A compression nut 64 having a suitable hand grip 66 threads onto the threaded end 68 of bolt 24. Compression nut 64 has a threaded hole 70 compatible with threaded end 68 of bolt 24. Resistance to free or unimpeded pivoting of hand levers 20, 22 about bolt 24 is adjusted by tightening and slackening compression nut 64. The low friction characteristics of washers 50, 52, 54, 56 cause resistance to increase and decrease gradually and progressively responsive to tightening and slackening of compression nut 64.

Figure 3:
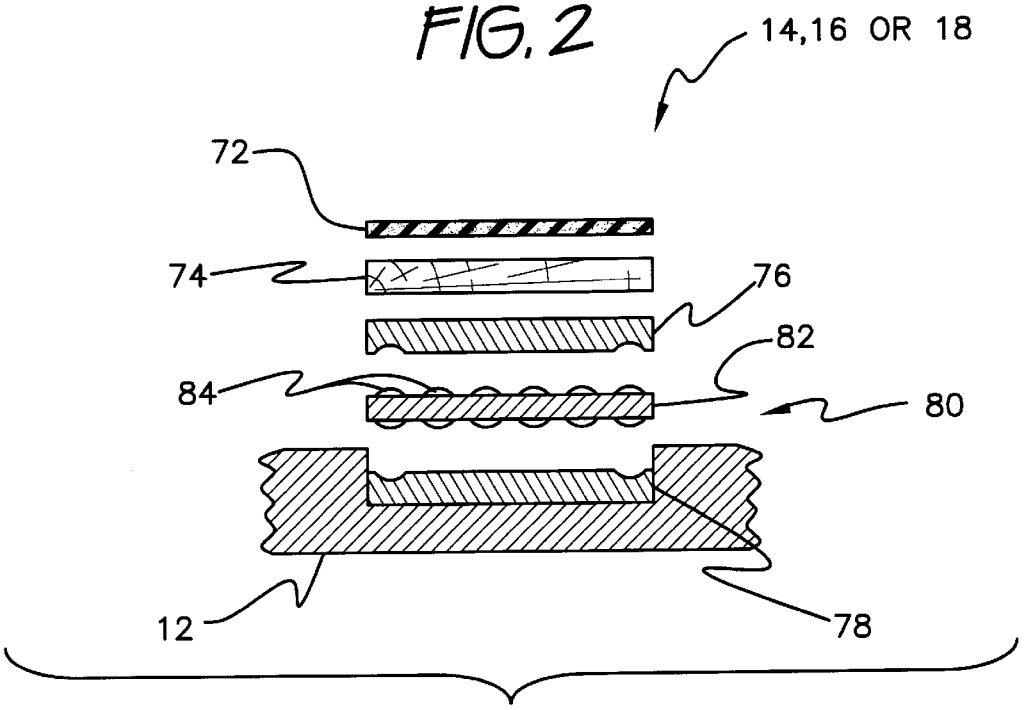
FIG. 3 is a diagrammatic exploded detail view typical of circular components seen towards the bottom of FIG. 1.

Details of a rotatable mounting typical of each foot platform 14, 16, or 18 are shown in FIG. 3. Each foot platform 14, 16, or 18 has a rubber tread member 72 mounted to a wooden platform 74. Wooden platform 74 is fixed to an upper bearing race 76 which rides rotatably on a lower bearing race 78. A bearing assembly 80 having a bearing retainer 82 holding ball bearings 84 in place is disposed between bearing races 76 and 78. Lower bearing race 78 is fixed to base 12. Upper bearing race 76 is suitably constrained against escaping from a captive position mounted to base 12. This may be accomplished by any known structure and method, details of which need not be set forth in further detail herein. Preferably, only tread member 72 projects above the upper surface of base 12 when foot platforms 14, 16, 18 are assembled and operable.

Automated functions of exercise machine 10 include counting repetitions of twisting motions, determining energy expended while exercising, displaying the aforementioned data, and producing musical or rhythmic audible accompaniment for exercising. The user may select and adjust these functions by operating controls shown in FIG. 4. The controls may be mounted on the rear panel of enclosure 44.

Controls include an on-off switch 86 controlling electrical power obtained from a power cord and plug assembly 87, a selector switch 88 selecting the style of music or beat to be produced by sound synthesizer 90 (see FIG. 5), an adjusting controller 92 selecting a pace or tempo of the music or beat, and a volume control 94 governing sound volume of the music or beat.

Optionally, display 38 may be controlled by pushbuttons 96, 98, 100 for displaying calculation of energy expended in the form of calories, the number of repetitions of twisting motions, and real or elapsed time.

Figure 5:
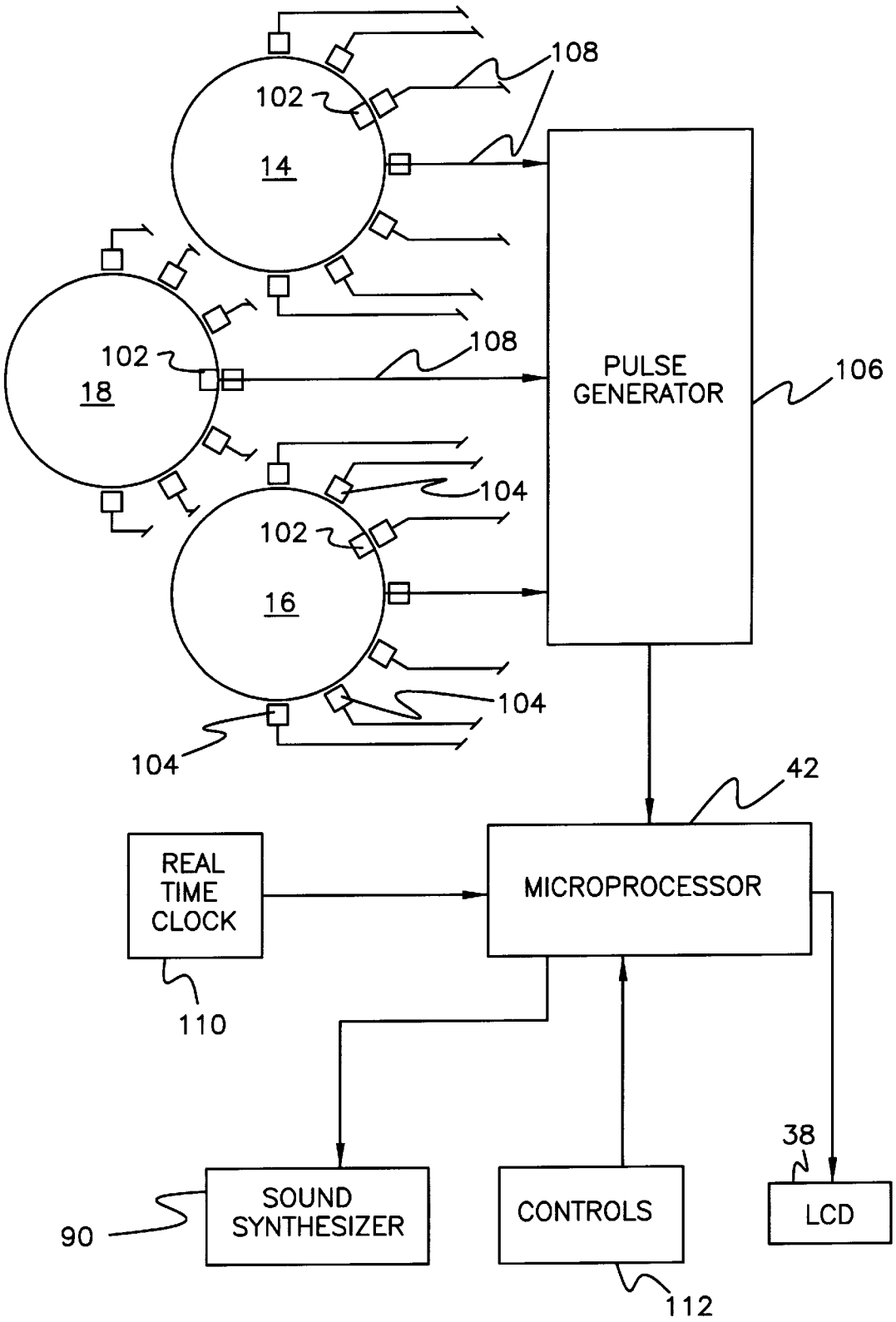
FIG. 5 is a block diagram illustrating control and logic components of the invention and their relationship.

Referring now to FIG. 5, apparatus enabling the automated functions is described. Each foot platform 14, 16, or 18 has mounted to wooden platform 74 or to upper bearing race 76 a signal generator, such as a magnet 102. A series of transducers 104 are disposed proximate each foot platform 14, 16, or 18 so as to sense passing of its associated signal generator 102. In the example depicted in FIG. 5, each foot platform 14, 16, or 18 has a first transducer 104 disposed at a position corresponding to the neutral position wherein signal generator 102 faces forwardly towards mast 28 (see FIG. 1). Additional transducers 104 are disposed at thirty degree intervals of deviation from the neutral position, so that each foot platform 14, 16, or 18 can signal the extent or magnitude of twisting motion achieved by the user. Each transducer 104 has a communications cable 108 transmitting a signal generated by proximity or passing of signal generator 102 with respect to each transducer 104 to pulse generator 106. Thus, signal generators 102 and transducers 104 combine to form sensors for sensing degree of pivot of each foot platform 14, 16, or 18 relative to base 12. Pulse generator 106 transforms signals derived from transducers 104 to a form compatible with microprocessor 42.

Microprocessor 42 receives inputs from pulse generator 106, from a real time clock or counter 110, and from controls 112. Controls 112 are collectively those described with reference to FIG. 4. Microprocessor 42 has a data processor (not separately shown), memory (not separately shown), and software (not separately shown) suitable for carrying out commands entered by controls 112 and for making calculations as described prior. Microprocessor 42 drives display 38 and controls sound synthesizer 90 according to commands entered by controls 112. Additional components, such as suitable relays, drivers, and other intermediate components well known in the art will be understood to be furnished where required. These components, as well as those of microprocessor 42 and suitable software, may be those employed for prior art computerized equipment, sound or music synthesizers, and need not be set forth in greater detail.

There has been set forth an exercise machine 10 capable of accommodating aerobic exercises and dance routines and having the further ability to generate music or other sounds for accompanying and directing exercises and dance routines, for counting and displaying the number of motions performed, and for calculating and displaying energy expended while exercising. The invention thus improves over prior art devices by providing the automated functions set forth above, thereby rendering the improved machine 10 complete and self-contained, obviating necessity for auxiliary audiovisual equipment, and enabling adjustments to be made according to the individual user's preferences. This invention is susceptible to variations and modifications which may be introduced without departing from the inventive concept.

For example, controls 88, 92, and 94 (see FIG. 4) are dedicated to specific characteristics of music or other sound generated by sound synthesizer 90 (see FIG. 5). Of course, other characteristics of the audible output of sound synthesizer 90 may be provided. Many musical and non-musical effects are known within the field of music generators, and any of these may be adapted to the present invention.

It would also be possible to locate controls 112 on or near display 38, so that they are readily available to the user, who may then control exercise machine 10 without dismounting. Microprocessor 42, sound synthesizer 90, pulse generator 106, time clock 110, and other components may be contained within enclosure 44 or alternatively within base 12, mast 28, the housing of display 38, or within any other suitable part of exercise machine 10.

Microprocessor may have software for relating magnitude and frequency of sensed twisting motions to energy expended.

The calculations performed thereby may be improved in accuracy by entering into memory data corresponding to body weight of the user or other parameters.

Hand levers 20, 22 may be mounted within base 12 rather than on mast 28. Foot platforms 14, 16, 18 may be rearranged as desired. The tension arrangement for adjusting resistance of hand levers 20, 22 may take other forms, such as by incorporating springs, fluid resistance, and other devices for imposing resistive forces on hand levers 20, 22.

Similarly, the arrangement utilizing pin 30 for immobilizing hand levers 20, 22 may take other forms, such as a threaded set screw.

It is to be understood that the present invention is not limited to the embodiments described above, but encompasses any and all embodiments within the scope of the following claims.

I claim:

1. An exercise machine comprising:

a base for supporting said exercise machine on a horizontal surface;

three foot platforms, each including a rotatable mounting for rotatably mounting said foot platform to said base;

positional sensor means for determining the magnitude of rotation of each said foot platform, said positional sensor means comprising at least one magnet attached at a predetermined location to each said foot platform and a plurality of transducers disposed on said base to sense the passage of said magnets and wherein said transducers are located proximate the periphery of said foot platforms;

a microprocessor for receiving signals from said positional sensor means, said microprocessor including means for calculating energy expenditure during periods of exercise on said exercise machine from said positional sensor signals, and where said microprocessor also includes means for calculating a sum of motions from said positional sensor signals during periods of exercise on said exercise machine;

a display for receiving and displaying calculated values from said microprocessor; and two hand levers projecting upwardly from said base, wherein two of said three foot platforms are located proximate to and equidistant from said hand levers and the remaining foot platform is located distally from said hand levers.

2. The exercise machine according to claim 1, further including a sound synthesizer affixed to said exercise machine, said sound synthesizer being capable of receiving signals from said positional sensor means and generating sounds in accordance therewith, said sound synthesizer also including controls for adjusting-characteristics of sound generated by said sound synthesizer.

3. An exercise machine comprising:

a base for supporting said exercise machine on a horizontal surface;

two hand levers projecting upwardly from said base;

a display;

a microprocessor, said microprocessor having means for transmitting data signals to said display, said display having means for displaying calculated values corresponding to signals received from said microprocessor;

three foot platforms, each of said foot platforms being rotatably mounted to said base, two of said foot platforms being located proximate and equidistantly from said hand levers and where the remaining said foot platform being located distally from said hand levers;

sensors for sensing rotation of each said foot platform relative to said base and means for communicating signals indicative of rotation of each said foot platform to said microprocessor, said microprocessor having first means for calculating energy expended during a period of exercise and a second means for calculating a sum of motions sensed by said sensors during a period of exercise; whereby calories expended and number of body motions are determined by said microprocessor and are displayed by said display.

4. The exercise machine according to claim 3, further including a sound synthesizer affixed to said exercise machine, said sound synthesizer being capable of receiving signals from said sensors and generating sounds in accordance therewith, said sound synthesizer also including controls for adjusting characteristics of sound generated by said sound synthesizer.

5. An exercise machine comprising:

a base for supporting said exercise machine on a horizontal surface;

two hand levers projecting upwardly from said base, said hand levers having pivotal mounting means enabling each said hand lever to pivot relative to said base, said hand levers including an adjustment mechanism for varying resistance counteracting pivoting of said hand levers relative to said base, and apparatus for immobilizing said hand levers relative to said base;

a display;

a microprocessor, said microprocessor having means for transmitting data signals to said display, said display having means for displaying calculated values corresponding to signals received from said microprocessor;

three foot platforms, each of said foot platforms being rotatably mounted to said base, two of said foot platforms being located proximate and equidistantly from said hand levers and where the remaining said foot platform being located distally from said hand levers;

sensors for sensing rotation of each said foot platform relative to said base and means for communicating signals indicative of rotation of each said foot platform to said microprocessor, said microprocessor having first means for calculating energy expended during a period of exercise and a second means for calculating a sum of motions sensed by said sensors during a period of exercise; whereby calories expended and number of body motions are determined by said microprocessor and are displayed by said display.

6. The exercise machine according to claim 5 further including a sound synthesizer affixed to said exercise machine, said sound synthesizer being capable of receiving signals from said sensors and generating sounds in accordance therewith, said sound synthesizer also including controls for adjusting characteristics of sound generated by said sound synthesizer.

* * * * *